US006959563B2

(12) United States Patent
Altendorfer et al.

(10) Patent No.: US 6,959,563 B2
(45) Date of Patent: Nov. 1, 2005

(54) INSERT FOR USE IN A REFRIGERANT RECEIVER

(75) Inventors: Siegbert Altendorfer, Wiener Neustadt (AT); Norbert Operschall, Oberwaltersdorf (AT)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/440,603

(22) Filed: May 19, 2003

(65) Prior Publication Data

US 2004/0031285 A1 Feb. 19, 2004

(30) Foreign Application Priority Data

May 17, 2002 (DE) ..... 102 21 968

(51) Int. Cl.[7] ..... F25B 43/00; F25B 39/04
(52) U.S. Cl. ..... 62/474; 62/509
(58) Field of Search ..... 62/474, 509, 475, 62/195, 512; 165/110, 132, 174; 210/287, 282

(56) References Cited

U.S. PATENT DOCUMENTS 6,374,632 B1 * 4/2002 Nobuta et al. ..... 62/509
2002/0157809 A1 10/2002 Kaspar et al.

FOREIGN PATENT DOCUMENTS

| | | |
|---|---|---|
| DE | 4421834 | 1/1996 |
| DE | 19926990 | 12/1999 |
| EP | 1104878 | 6/2001 |
| EP | 1147930 | 10/2001 |
| FR | 2750761 | 1/1998 |
| JP | 2000213826 | 8/2000 |
| JP | 2000283605 | 10/2000 |

* cited by examiner

*Primary Examiner*—Chen Wen Jiang
(74) *Attorney, Agent, or Firm*—Wood, Phillips, Katz, Clark & Mortimer

(57) ABSTRACT

An insert is provided for use in a refrigerant receiver of a vehicular air conditioning system. The receiver has an interior that receives the insert and a charge of desiccant. The receiver is connected to a header of a condenser by a refrigerant inlet to the interior from the header and a refrigerant outlet from the interior to the header. The insert includes a wall having a first and second oppositely facing sides. The first side lies closer to the inlet than the second side with the insert received in the interior of the receiver. A first portion of the wall is aligned with the inlet, and at least the first portion is substantially impervious to the refrigerant flow from the inlet to shield the desiccant charge from direct impingement by refrigerant flow from the inlet. In one embodiment, the second side cooperates with a surface of the interior to define a receptacle for the desiccant. In another embodiment, the second side defines a receptacle surrounding the desiccant.

16 Claims, 3 Drawing Sheets

INSERT FOR USE IN A REFRIGERANT RECEIVER

RELATED APPLICATIONS

This application claims priority under 35 U.S.C. §119 to German patent application no. DE 102 21 968.01 filed May 17, 2002, the disclosure of which is incorporated herein by reference.

FIELD OF THE INVENTION

This invention relates to inserts for use in refrigerant receivers, and in particular to inserts for use in refrigerant receivers of vehicular air conditioning systems.

BACKGROUND OF THE INVENTION

Inserts for use in the refrigerant receivers of vehicular air conditioning systems are known. Often, the inserts will be used as a container for a charge of desiccant and may also include a filter for the refrigerant passing through the receiver. In some known constructions, the insert will include a perforated cylindrical wall that surrounds the desiccant. An example of one insert that meet the above description is shown in EP 1 147 930 B1, which is commonly assigned with the present application.

While many of the known inserts may be suitable for their intended purposes, there is always room for improvements. For example, one functional drawback of known inserts is that the desiccant, which is typically provided in a granular form, is ground up in a relatively short time by abrasion caused by the flow of refrigerant. The abraded desiccant does not perform its intended function as well and, further, must be filtered from the refrigerant.

SUMMARY OF THE INVENTION

It is the primary object of the invention to provide an improved insert for use in a refrigerant receiver of a vehicular air conditioning system.

It is another object of the invention to provide such an insert that delays or reduces the abrasion of the desiccant held within the receiver.

According to one aspect of the invention, an insert is provided for use in a refrigerant receiver of a vehicular air conditioning system, the receiver having an interior that receives the insert and a charge of desiccant. The receiver is connected to a header of a condenser via a refrigerant inlet to the interior from the header and a refrigerant outlet from interior to the header.

In one form, the insert includes a wall having first and second oppositely facing sides. The first side lies closer to the inlet than the second side with the insert received in the interior of the receiver. A first portion of the wall is aligned with the inlet with the insert received in the interior of the receiver, and at least the first portion is substantially impervious to a refrigerant flow from the inlet to shield the desiccant charge from direct impingement by refrigerant flow from the inlet.

In one form, the second side cooperates with a surface of the interior to define a receptacle for the desiccant with the insert received in the interior of the receiver.

In one form, a second portion of the wall is spaced from the inlet with the insert received in the interior of the receiver and is perforated to allow the refrigerant flow to pass from the first side to the second side of the wall after the refrigerant flow has been diverted by the first portion.

In one form, the wall is flat.

In one form, the wall has an arc shaped cross-section.

According to one form, the wall includes two opposite edges that bound the first and second sides. The edges are spaced from the surface of the interior to allow the refrigerant flow to pass from the first side to the second side of the wall after the refrigerant flow has been diverted by the first portion.

According to another form, the wall includes two opposite edges that bound the first and second sides. With the insert received in the interior, the edges are engaged against the surface of the interior to restrict the flow of refrigerant from the first side to the second side of the wall.

In one form, the wall is configured to clamp the desiccant charge against the surface of the interior with the insert received in the interior.

In one form, the insert further includes a plug connected to an end of the wall. The plug seals the receiver with the insert received in the interior.

According to one form, the insert further includes a filter basket connected to an end of the wall, and a seal arranged on the filter basket to engage the surface of the interior to restrict flow of the refrigerant past the seal. The filter basket includes openings on a side of the seal closest to the inlet to allow flow of the refrigerant into an interior of the filter basket and a filter on an opposite side of the seal to filter flow of the refrigerant passing from the interior of the filter basket. In a further form, the filter basket is cylindrical, the filter is formed in a cylindrical wall of the filter basket, and the seal is arranged in an annular gap between the filter basket and the interior of the receiver.

In one form, the second side defines a receptacle surrounding the desiccant, and a second portion of the wall is spaced from the inlet with the insert received in the interior and is perforated to allow the refrigerant flow to pass from the first side to the second side of the wall after the refrigerant flow has been diverted by the first portion.

Other objects, features, and advantages of the invention will best be understood after reviewing the entire specification, including the appended drawings and claims.

DETAILED DESCRIPTION OF THE PREFERRED EMBODIMENTS

Figure 1:
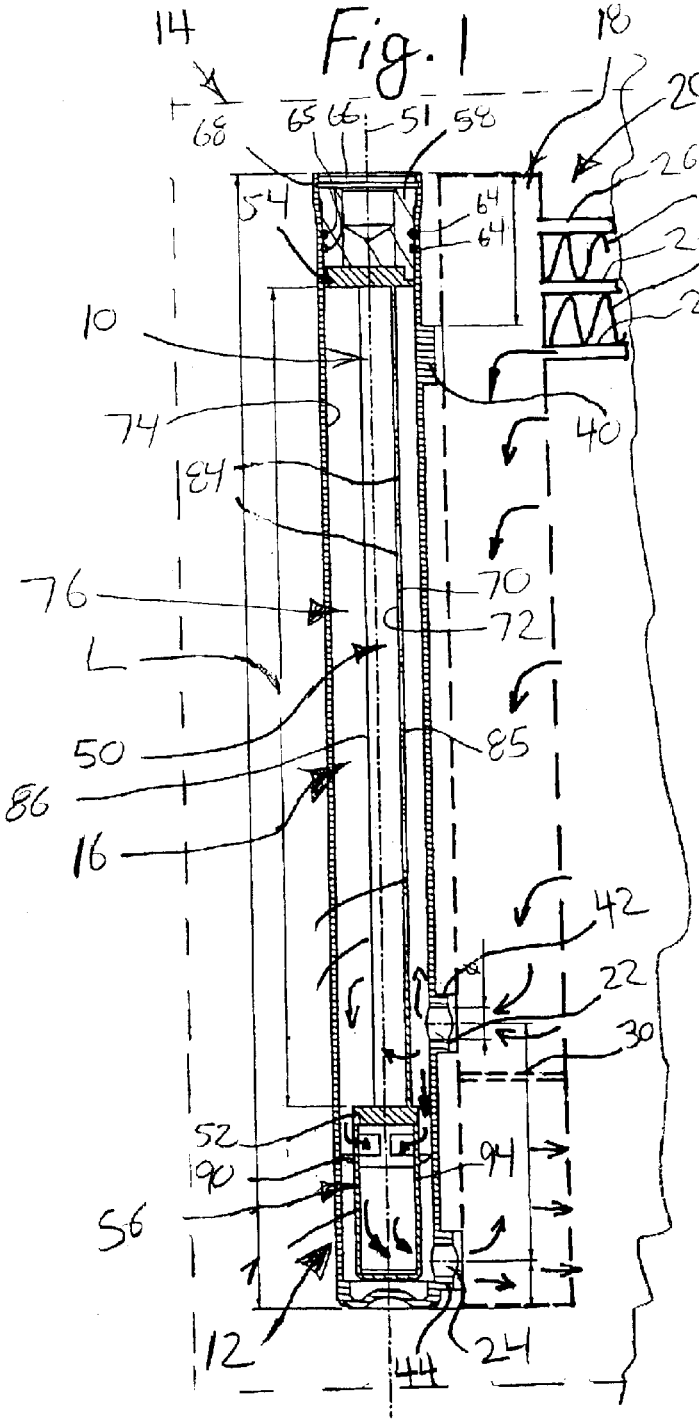
FIG. 1 shows a cross section of a refrigerant receiver of a vehicular air conditioning system with an insert embodying the present invention received in the interior of the receiver.

As seen in FIG. 1, an insert 10 is provided for use in a refrigerant receiver 12 of a vehicular air conditioning system, shown schematically at 14. The receiver 12 is cylindrical and has an interior 16 that receives the insert 12 and a charge of desiccant (not shown). The receiver 12 is connected to a cylindrical header 18 (shown in phantom in FIG. 1) of a condenser 20 (only partially shown in FIG. 1) via a refrigerant inlet 22 to the interior 16 from the header 18 and a refrigerant outlet 24 from the interior 16 to the header 18.

While the condenser 20 may be of any suitable construction, many of which are known, in the illustrated embodiment the condenser 20 includes a plurality of parallel, spaced flat tubes 26 with a plurality of serpentine fins 28 located between the tubes 26, and both the tubes 26 and the fins 28 extending between the header 18 and an opposite header that is not shown. In the illustrated embodiment, the header 18 includes a baffle 30 just below the inlet 22. In operation, the refrigerant flows through a first set of the tubes 26 into the header 18, then is directed into the interior 16 of the receiver 12 via the inlet 22 by the baffle 30. The refrigerant then flows through the interior 16 of the receiver past the various parts of the insert 10 and exits from the interior 16 to the header 18 via the outlet 24. After returning to the header 18, the refrigerant is distributed to another set of the tubes 26 so as to flow back to the opposite header. This flow pattern is illustrated by arrows in FIG. 1. While any suitable structure may be used to connect the receiver 12 to the header 18, in the illustrated embodiment, first, second, and third conforming mounts 40, 42, and 44 extend from the exterior surface of the receiver 12, with the mounts 42 and 44 surrounding the inlet 22 and the outlet 24, respectively, and bonded in a liquid tight fashion, such as by brazing, to the header to prevent leakage of the refrigerant.

Having described several details of the illustrated embodiments of the receiver 12 and condenser 20, it should be understood that these details are secondary in nature and are provided to help describe the function of the insert 10. Accordingly, it should be understood that the insert 10 can be used with any suitable construction for the receiver 12 and condenser 20, many of which are known for vehicular applications. By way of example, several of the inlets 22 and outlets 24 could be provided between the receiver 12 and the header 18. By way of further example, while the receiver 12 and header 18 are shown as cylindrical in shape, other shapes may be employed.

Figure 3:
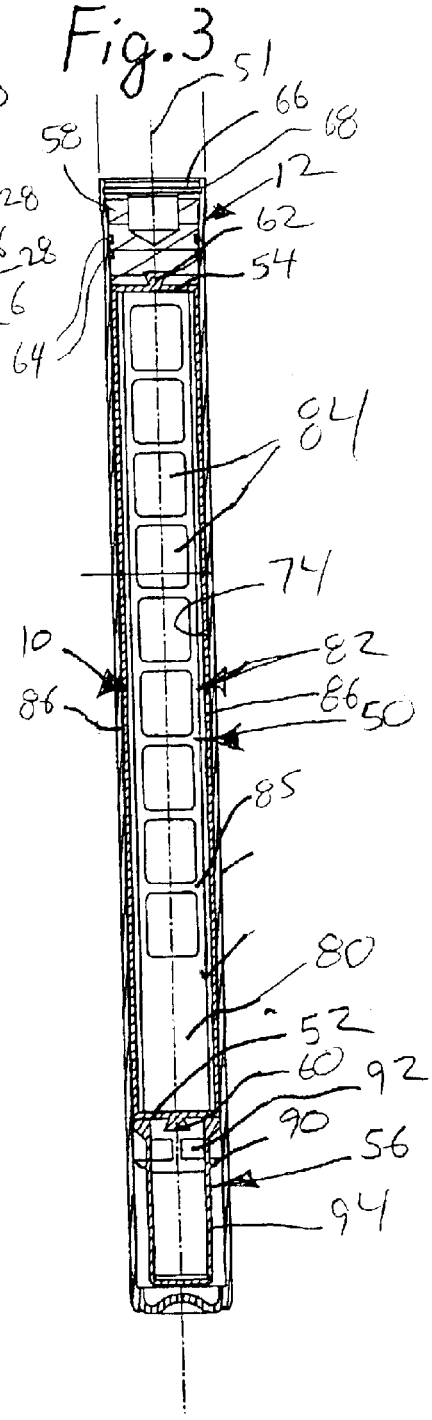
FIG. 3 is a cross section of the receiver taken 90° from the cross section of FIG. 1.

Turning now to the details of the illustrated embodiment of the insert 10, it can be seen in FIGS. 1 and 3 that the insert 10 includes a wall 50 that extends parallel to a longitudinal axis 51 from a lower platform 52 to an upper platform 54, a filter basket 56 connected to a lower end of the wall 50 by the lower platform 52, and an upper closure plug 58 connected to an upper end of the wall 50 by the upper platform 54. In the illustrated embodiment, the interior 16 is cylindrical and is centered on the axis 51. Preferably, the filter basket 56 and the plug 58 are ireleaseably attached to the lower and upper platforms 52 and 54, respectively, by respective dovetail joints 60 and 62, as best seen in FIG. 3. However, it should be appreciated that any suitable connection can be used between these components including connections that are non-releaseable. Preferably, the plug 58 includes a pair of annular seals 64 received in annular groves 65 formed in the plug to prevent leakage of the refrigerant from the interior 16 of the receiver pass the plug 58. Further, preferably a snap ring 66 received in an annular groove 68 formed in the receiver 12 retains the plug 58 and the insert 10 in the receiver 12 during the operation. While preferred embodiments have been shown, it should be appreciated that any suitable means may be used for sealing and retaining the plug 58 with respect to the receiver 12.

The wall 50 has first and second oppositely facing sides 70 and 72, with the side 70 lying closer to the inlet 22 than the side 72. The side 72 cooperates with a surface 74 of the interior 16 of the receiver 12 to define a receptacle 76 for the desiccant charge. The receptacle 76 is bounded on its lower and upper ends by the platforms 52 and 54, respectively. A lower portion 80 of the wall 50 is substantially impervious to the refrigerant flow from the inlet 22 to shield the desiccant charge contained in the receptacle 76 from direct impingement by the refrigerant flow from the inlet 22. As used herein, the term "substantially impervious" is intended to mean that the lower portion will prevent a flow of refrigerant from the inlet 22 from directly impinging on the desiccant charge contained in the receptacle with sufficient kinetic energy to abrade the desiccant charge. Thus, for example, a lower portion that would allow a small amount of low velocity seepage of the refrigerant through the wall 50 that does not damage the desiccant would be "substantially impervious" to the refrigerant flow on the inlet 22. In the illustrated embodiment, the lower portion of the wall is imperforate or solid. An upper portion 82 of the wall 50 is perforated to allow the refrigerant flow to pass from the side 70 to the side 72 into the receptacle 76 after the refrigerant flow has been diverted by the first portion 80. In the illustrated embodiment, the upper portion 82 is perforated by a number of window type openings 84, with the openings 84 preferably having a greater surface fraction than the solid parts 85 of the wall 50 remaining in the upper portion 82 so as to minimize the flow resistance for the refrigerant. As best seen in FIG. 3 the wall 50 includes a pair of oppositely spaced edges 86 extending parallel to the longitudinal axis 51, and bounding the sides 70 and 72. In the illustrated embodiment, the side edges 86 are engaged against the surface 74 of the interior 16 so as to restrict or prevent the flow of refrigerant laterally around the wall 50 from the first side 70 to second side 72. Additionally, this engagement improves the positional stability of the insert 10 in the receiver 12. In another embodiment (not shown) the edges 86 are spaced from the surface 74 of the interior 16 to allow the refrigerant to flow laterally around the wall 50. In this example, the windows 84 could be dispensed with.

While the sides 72 is shown as open, the side 72 could be intersected by connection strips (not shown), in order to make the insert 10 more stable. Furthermore, while the cross section of the wall 50 in the illustrated embodiment is arc shaped, other shapes are possible. For example the wall 50 could be flat.

Figure 2:
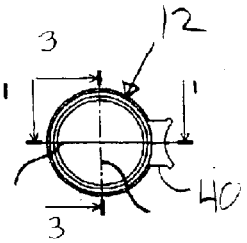
FIG. 2 is a top view of the receiver of FIG. 1.

Because the lower portion 80 is essentially impervious to the refrigerant flow, the refrigerant flow cannot impact directly on the desiccant granules in the receptacle 76 and grind them down with its kinetic energy, but rather is initially deflected upward and/or downward and/or laterally by the lower portion 80. The spacing of the wall 50 in the portion 80 is most apparent from FIG. 2 and is preferably chosen so that the space in the receiver 12 is available mostly as a receiving space for the desiccant charge 100. In FIG. 2, the wall 50 is positioned to lie roughly half way between the axis 51 and the wall 74 adjacent the inlet 22. It is believed that this spacing will maintain the pressure loss of the refrigerant within tolerable limits.

The filter basket 56 in the illustrated embodiment is roughly cylindrical with an annular seal 90 in the form of an annular lip arranged on the filter basket and extending outwardly therefrom to engage the surface 74 of the interior 16 to restrict or block the flow of the refrigerant past the seal 90, thereby ensuring that the refrigerant must flow through the filter basket 56 on its way to the outlet 24. The filter basket 56 includes window shaped openings 92 on the upperside of the seal 90, which is closet to the inlet 22, to allow the refrigerant to flow into the interior of the filter basket 56. In the illustrated embodiment, a cylindrical wall 94 of the filter basket 56 lying below the seal 92 is designed as a filter so as to filter the refrigerant flow passing from the interior of the basket 56 on its way to the outlet 24. One feature of the filter basket is that it collects any residue blocked by the filter 94 in the interior of the filter basket 56, and this residue can be removed with the insert 10 from the receiver 12 during servicing.

Figure 4:
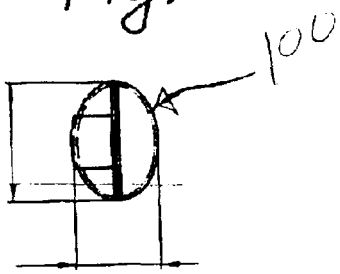
FIGS. 4, 5 and 6 are top, side, and front views of a desiccant sack that can be used in connection with the insert of FIG. 1.
Figure 5:
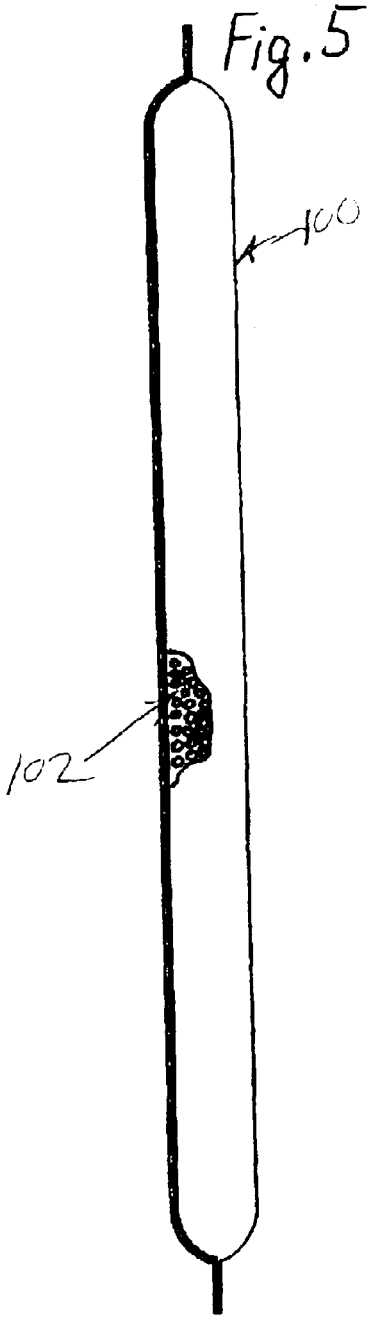
Figure 6:
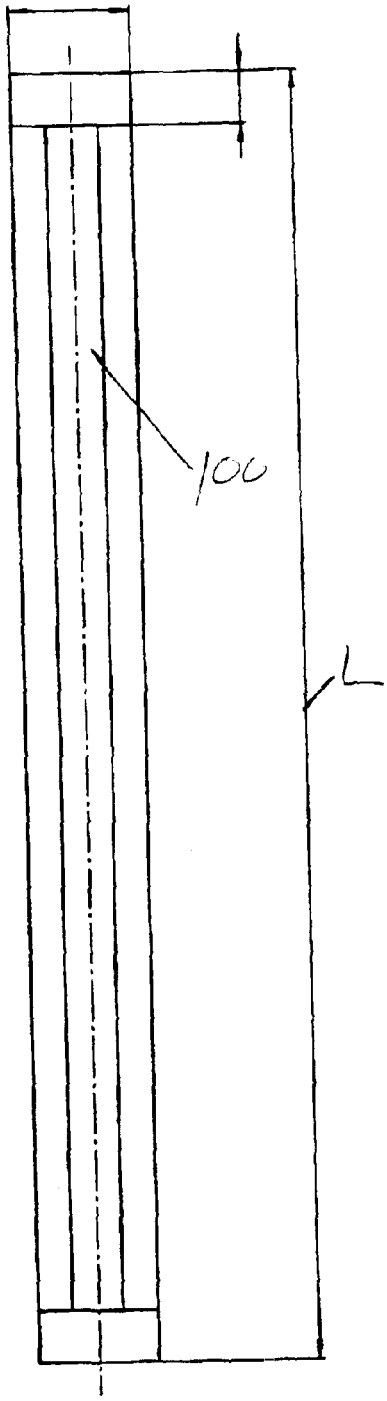

FIGS. 4, 5, and 6 show one embodiment for the desiccant charge in the form of a desiccant sack 100 that contains a charge of granular desiccant 102. The desiccant 100 is drawn roughly oval and therefore corresponds roughly to the cross section that is present in the receptacle 76 between the surfaces 74 and 72. In the illustrated embodiment, the length L of the desiccant sack 100 roughly corresponds to the length L of the receptacle 76, so that the space within the receptacle 76 is roughly filled up by the desiccant sack 100. Because the desiccant sack 100 roughly fills up the space within the receptacle 76, the desiccant sack 100 need not be additionally fastened into the receptacle 76, since it is held in place by the surfaces 72 and 74. Furthermore, the conforming shape of the desiccant sack allows for simple insertion of the insert 10 together with the desiccant sack 100 into the receiver 12. Furthermore, the preferred snug fit of the desiccant sack 100 prevents significant movements of the desiccant 100 during operation, which movements could be considered undesirable.

Figure 7:
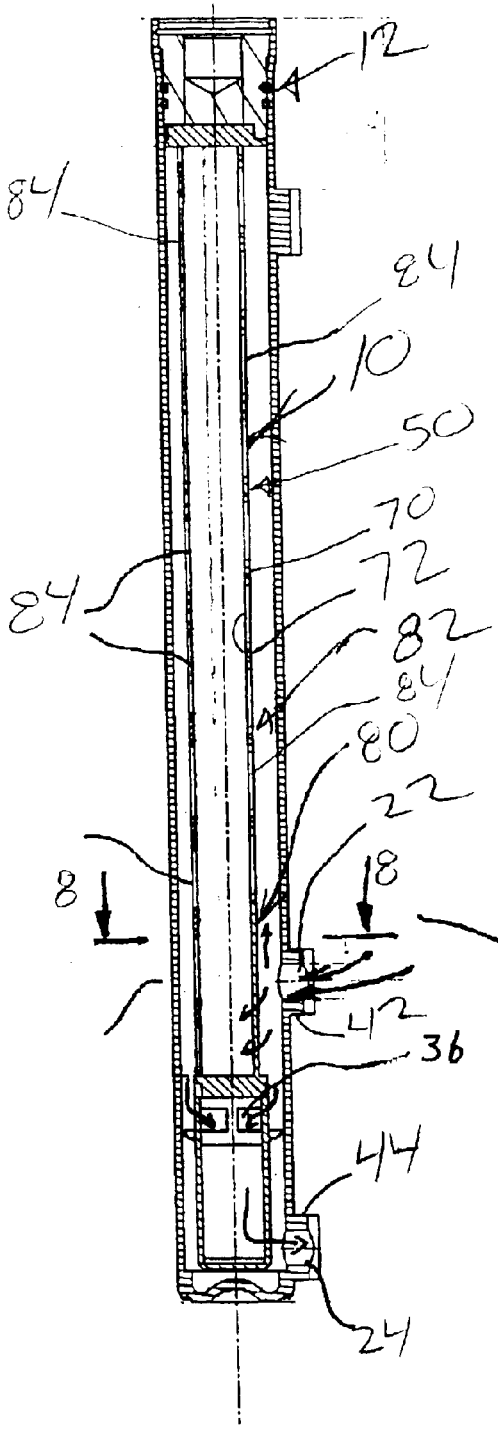
FIG. 7 is a cross section similar to the cross section of FIG. 1, but showing an alternate embodiment of the insert.
Figure 8:
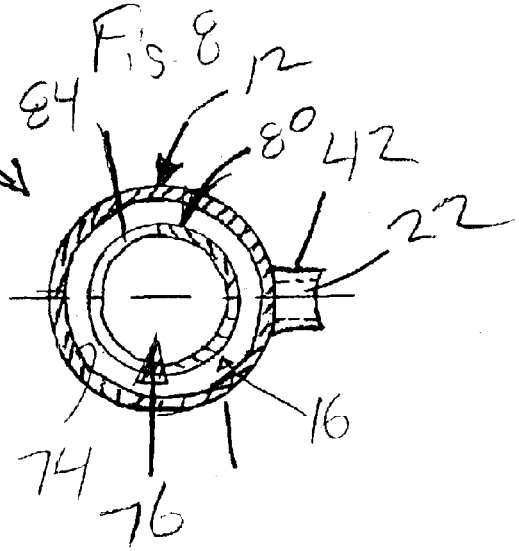
FIG. 8 is a cross section taken from line 8—8 in FIG. 7.
Figure 4:
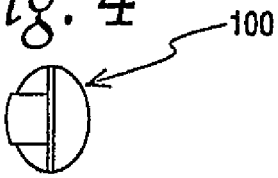
Figure 5:
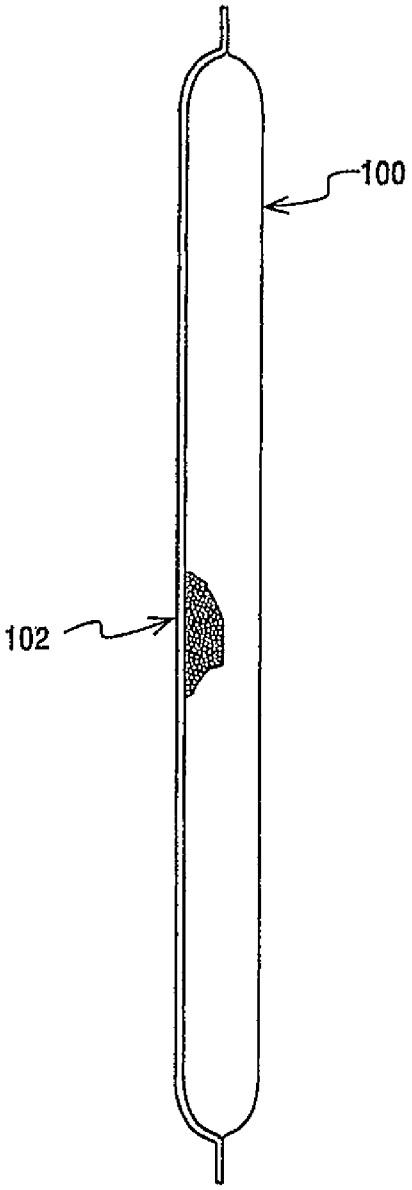
Figure 6:
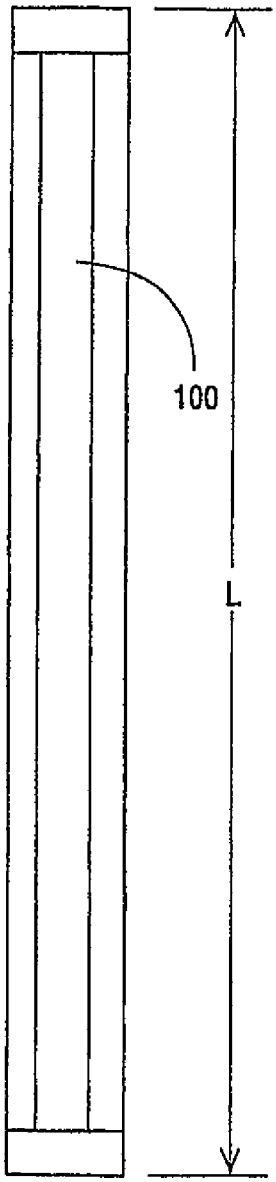
Figure 7:
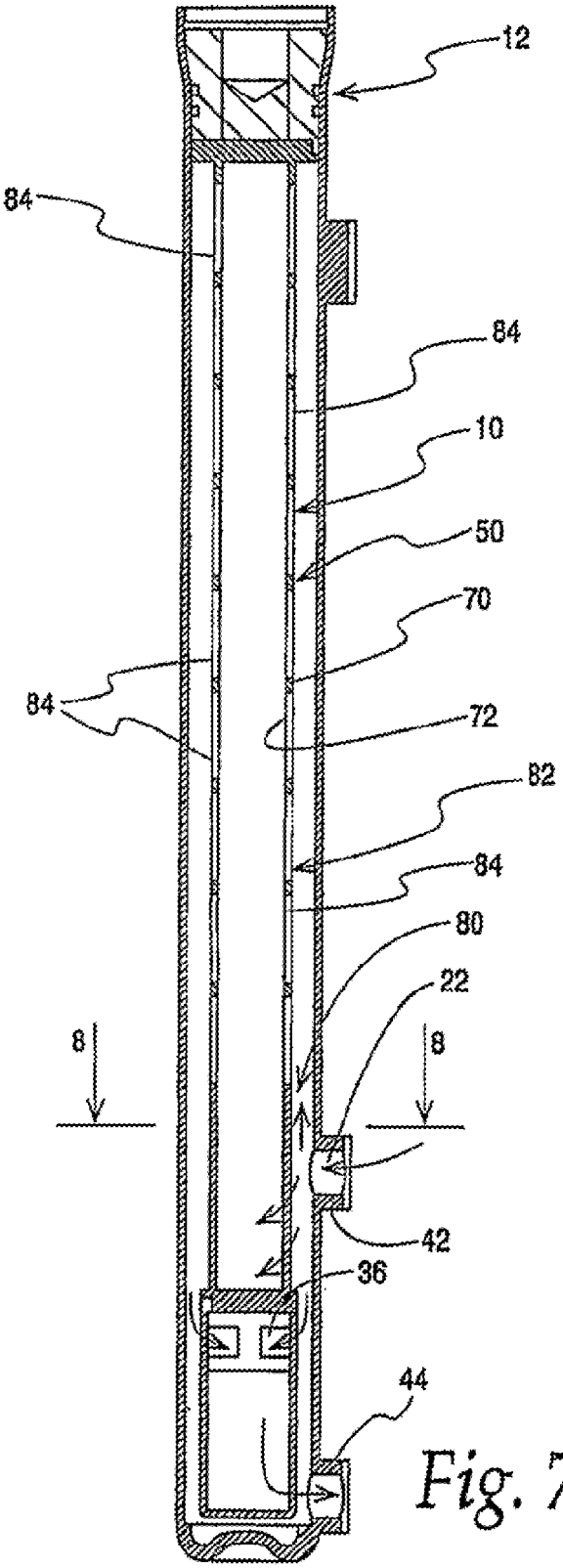
Figure 8:
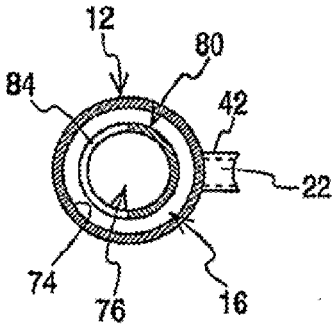

FIGS. 7 and 8 show an alternate embodiment for the insert 10 wherein the wall 50 is a cylindrical wall so that the second surface 72 defines the receptacle 76 surrounding the desiccant charge (not shown). In this embodiment, the portions of the wall 50 that are radially opposite the lower impervious portion 80 of the wall 50 may include some of the openings 84 to allow flow of refrigerant into the receptacle 76 after it has been diverted by the portion 80 of the wall 50, as best seen in FIG. 8. Other aspects of the embodiment of FIGS. 7 and 8 are as previously described for the embodiment of FIGS. 1–3, or can be designed as in EP 1 147 930 B1 published Dec. 5, 2001, the entire disclosure of which is incorporated herein by reference.

Preferably, the insert 10 and all of its components are made from a suitable plastic.

It should be appreciated that by making the portion 80 of the wall 50 lying closest to the inlet opening 22 essentially impervious or imperforate, the refrigerant flow from the inlet 22 cannot directly impinge against the desiccant charge in the receptacle 76 with sufficient force to abrade the desiccant. Furthermore, the diversion of the refrigerant flow laterally and/or upwardly and/or downwardly tends to wet the desiccant charge more uniformly after it flows from the side 70 to the side 72. Because of this, the desiccant can remain suitable for use for a longer period of time. Furthermore, it is believed that the flow diversion improves separation of the vaporized refrigerant from the liquid refrigerant within the receiver 12.

It should also be appreciated that for the embodiment shown in FIGS. 1–3, the desiccant charge 100 and the insert 10 can be produced and made available as individual parts, but can be inserted together into the receiver 12, which can be a more cost-effective approach during the assembly of the condenser 20. It should further be appreciated that the roughly arc-like shape of the wall 50 in the embodiment illustrated in FIGS. 1–3 tends to hold the desiccant charge during assembly, thereby further easing insertion.

I claim:

1. An insert for use in a refrigerant receiver of a vehicular air conditioning system, the receiver having an interior that receives the insert and a charge of desiccant, the receiver being connected to a header of a condenser via a refrigerant inlet to the interior from the header and a refrigerant outlet from the interior to the header, the insert comprising:

a wall having first and second oppositely facing sides, the first side lying closer to the inlet than the second side with the insert received in the interior of the receiver, the second side cooperating with a surface of the interior to define a receptacle for the desiccant with the insert received in the interior of the receiver, a first portion of the wall being aligned with the inlet with the insert received in the interior of the receiver, at least the first portion being substantially impervious to a refrigerant flow from the inlet to shield the desiccant charge from direct impingement by the refrigerant flow from the inlet.

2. The insert of claim 1 wherein a second portion of the wall spaced from the inlet with the insert received in the interior is perforated to allow the refrigerant flow to pass from the first side to the second side of the wall after the refrigerant flow has been diverted by the first portion.

3. The insert of claim 1 wherein the wall is flat.

4. The insert of claim 1 wherein the wall has an arc shaped cross-section.

5. The insert of claim 1 wherein the wall has two opposite edges that bound said sides, the edges being spaced from the surface of the interior to allow the refrigerant flow to pass from the first side to the second side of the wall after the refrigerant flow has been diverted by the first portion.

6. The insert of claim 1 wherein the wall is configured to clamp the desiccant charge against the surface of the interior with the insert received in the interior.

7. The insert of claim 1 further comprising a plug connected to an end of the wall, the plug sealing the receiver with the insert received in the interior.

8. The insert of claim 1 further comprising a filter basket connected to an end of the wall, and a seal arranged on the filter basket to engage the surface of the interior to restrict flow of the refrigerant past the seal, the filter basket including openings on a side of the seal closest to the inlet to allow flow of the refrigerant into an interior of the filter basket and a filter on an opposite side of the seal to filter flow of the refrigerant passing from the interior of the filter basket.

9. The insert of claim 8 wherein the filter basket is cylindrical, the filter is formed in a cylindrical wall of the filter basket, and the seal is arranged in an annular gap between the filter basket and the interior of the receiver.

10. An insert for use in a refrigerant receiver of a vehicular air conditioning system, the receiver having an interior that receives the insert and a charge of desiccant, the receiver being connected to a header of a condenser via a refrigerant inlet to the interior from the header and a refrigerant outlet from the interior to the header, the insert comprising:

a wall having first and second oppositely facing sides, the first side lying closer to the inlet than the second side with the insert received in the interior of the receiver, the second side cooperating with a surface of the interior to define a receptacle for the desiccant with the insert received in the interior of the receiver, a first portion of the wall being aligned with the inlet with the insert received in the interior of the receiver, at least the first portion being substantially impervious to a refrigerant flow from the inlet to shield the desiccant charge from direct impingement by the refrigerant flow from the inlet, wherein the wall comprises two opposite edges that bound said sides, the edges being engaged against the surface of the interior to restrict the flow of refrigerant from the first side to the second side of the wall with the insert received in the interior.

11. An insert for use in a refrigerant receiver of a vehicular air conditioning system, the receiver having an interior that receives the insert and a charge of desiccant, the receiver being connected to a header of a condenser via a refrigerant inlet to the interior from the header and a refrigerant outlet from the interior to the header, the insert comprising:

a wall having first and second oppositely facing sides, the first side lying closer to the inlet than the second side with the insert received in the interior of the receiver, a first portion of the wall being aligned with the inlet with the insert received in the interior of the receiver, at least the first portion being substantially impervious to a refrigerant flow from the inlet to shield the desiccant charge from direct impingement by the refrigerant flow from the inlet.

12. The insert of claim 11 wherein the second side cooperates with a surface of the interior to define a receptacle for the desiccant with the insert received in the interior of the receiver.

13. The insert of claim 11 wherein the second side defines a receptacle surrounding the desiccant and a second portion of the wall is spaced from the inlet with the insert received in the interior is perforated to allow the refrigerant flow to pass from the first side to the second side of the wall after the refrigerant flow has been diverted by the first portion.

14. The insert of claim 13 further comprising a plug connected to an end of the wall, the plug sealing the receiver with the insert received in the interior.

15. The insert of claim 13 further comprising a filter basket connected to an end of the wall, and a seal arranged on the filter basket to engage the surface of the interior to restrict flow of the refrigerant past the seal, the filter basket including openings on a side the seal closest to the inlet to allow flow of the refrigerant into an interior of the filter basket and a filter on an opposite side of the seal to filter flow of the refrigerant passing from the interior of the filter basket.

16. The insert of claim 13 wherein the filter basket is cylindrical, the filter is formed in a cylindrical wall of the filter basket, and the seal is arranged in an annular gap between the filter basket and the interior of the receiver.

* * * * *

UNITED STATES PATENT AND TRADEMARK OFFICE

CERTIFICATE OF CORRECTION

PATENT NO. : 6,959,563 B2
APPLICATION NO. : 10/440603
DATED : November 1, 2005
INVENTOR(S) : Siegbert Altendorfer et al.

It is certified that error appears in the above-identified patent and that said Letters Patent is hereby corrected as shown below:

Title page should be deleted and substitute therefor the attached title page.

Please substitute drawings for FIGS. 1-8, which are attached.

Signed and Sealed this

Eighteenth Day of September, 2007

JON W. DUDAS
*Director of the United States Patent and Trademark Office*

(12) United States Patent
Altendorfer et al.

(10) Patent No.: US 6,959,563 B2
(45) Date of Patent: Nov. 1, 2005

(54) INSERT FOR USE IN A REFRIGERANT RECEIVER

(75) Inventors: Siegbert Altendorfer, Wiener Neustadt (AT); Norbert Operschall, Oberwaltersdorf (AT)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/440,603

(22) Filed: May 19, 2003

(65) Prior Publication Data

US 2004/0031285 A1 Feb. 19, 2004

(30) Foreign Application Priority Data

May 17, 2002 (DE) ..... 102 21 968

(51) Int. Cl.[7] ..... F25B 43/00; F25B 39/04
(52) U.S. Cl. ..... 62/474; 62/509
(58) Field of Search ..... 62/474, 509, 475, 62/195, 512; 165/110, 132, 174; 210/287, 282

(56) References Cited

U.S. PATENT DOCUMENTS 6,374,632 B1 * 4/2002 Nobuta et al. ..... 62/509
2002/0157609 A1 10/2002 Kaspar et al.

FOREIGN PATENT DOCUMENTS

| | | |
|---|---|---|
| DE | 4421834 | 1/1995 |
| DE | 19926990 | 12/1999 |
| EP | 1104878 | 6/2001 |
| EP | 1147930 | 10/2001 |
| FR | 2750761 | 1/1998 |
| JP | 2000213826 | 8/2000 |
| JP | 2000283605 | 10/2000 |

* cited by examiner

*Primary Examiner*—Chen Wen Jiang
(74) *Attorney, Agent, or Firm*—Wood, Phillips, Katz, Clark & Mortimer

(57) ABSTRACT

An insert is provided for use in a refrigerant receiver of a vehicular air conditioning system. The receiver has an interior that receives the insert and a charge of desiccant. The receiver is connected to a header of a condenser by a refrigerant inlet to the interior from the header and a refrigerant outlet from the interior to the header. The insert includes a wall having a first and second oppositely facing sides. The first side lies closer to the inlet than the second side with the insert received in the interior of the receiver. A first portion of the wall is aligned with the inlet, and at least the first portion is substantially impervious to the refrigerant flow from the inlet to shield the desiccant charge from direct impingement by refrigerant flow from the inlet. In one embodiment, the second side cooperates with a surface of the interior to define a receptacle for the desiccant. In another embodiment, the second side defines a receptacle surrounding the desiccant.

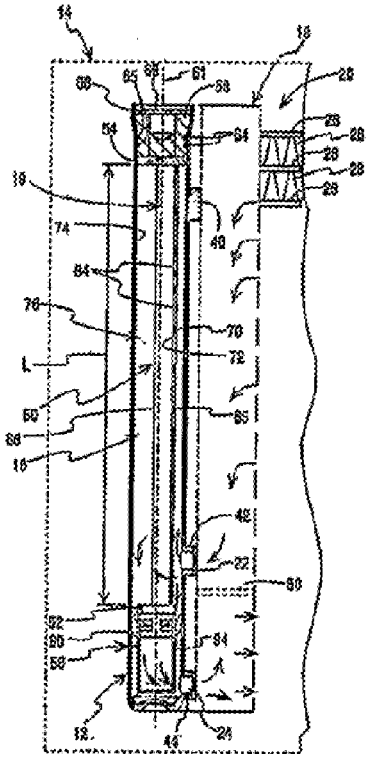

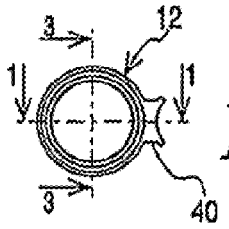
Fig. 2
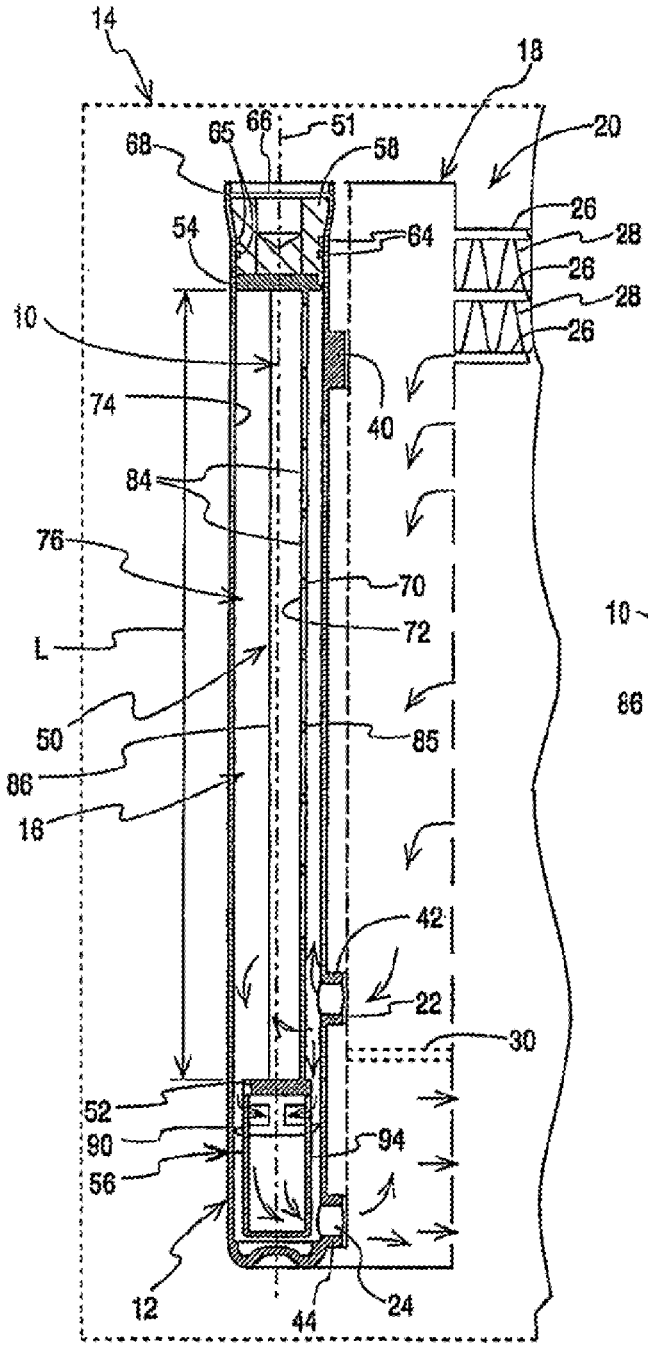
Fig. 3
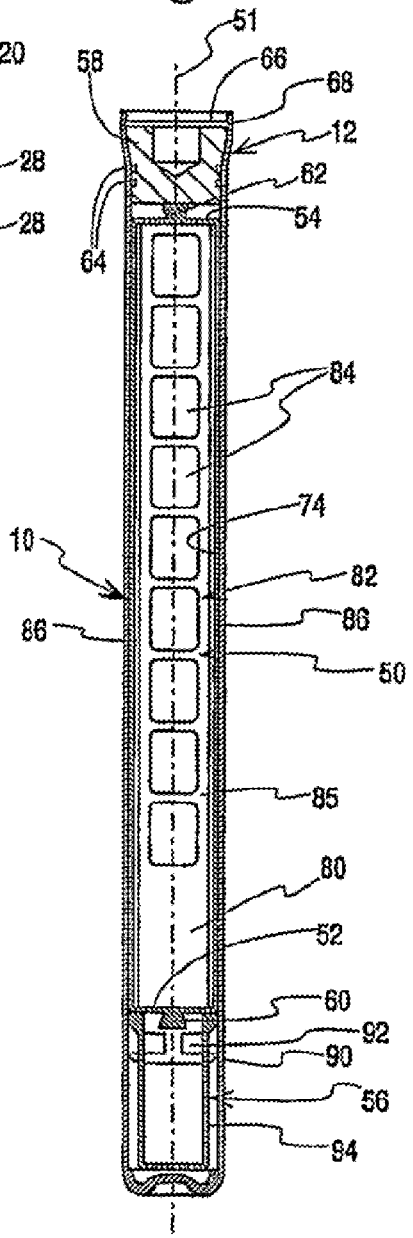

16 Claims, 3 Drawing Sheets